US007955487B2

(12) United States Patent
Kohnle et al.

(10) Patent No.: US 7,955,487 B2
(45) Date of Patent: Jun. 7, 2011

(54) DEVICE AND METHOD FOR ELECTROLYTICALLY TREATING FLAT WORK PIECES

(75) Inventors: Franz Kohnle, Berlin (DE); Klaus Hechler, Embu-Sp (BR)

(73) Assignee: Atotech Deutschland GmbH, Berlin (DE)

( * ) Notice: Subject to any disclaimer, the term of this patent is extended or adjusted under 35 U.S.C. 154(b) by 1224 days.

(21) Appl. No.: 11/569,825

(22) PCT Filed: Jun. 15, 2005

(86) PCT No.: PCT/EP2005/006553

§ 371 (c)(1),
(2), (4) Date: Nov. 30, 2006

(87) PCT Pub. No.: WO2005/123990

PCT Pub. Date: Dec. 29, 2005

(65) Prior Publication Data

US 2008/0257752 A1 Oct. 23, 2008

(30) Foreign Application Priority Data

Jun. 17, 2004 (DE) ..... 10 2004 029894

(51) Int. Cl.
*C25D 7/06* (2006.01)

(52) U.S. Cl. ..... 205/137; 205/138; 204/198; 204/206; 204/207

(58) Field of Classification Search ..... 205/137–142; 204/198, 206–211
See application file for complete search history.

(56) References Cited

U.S. PATENT DOCUMENTS 5,584,984 A * 12/1996 Pempera et al. ..... 205/704

* cited by examiner

*Primary Examiner* — Arun S Phasge
(74) *Attorney, Agent, or Firm* — Paul & Paul

(57) ABSTRACT

The invention relates to a device and method for electrolytically treating flat work pieces (1), more especially for electrolytically treating electrically conductive structures S that are electrically insulated against each other on the surfaces of the work pieces. The method comprises conveying and processing the work pieces (1) on the conveying paths T', T" in the device, said device comprising at least one assembly A located between tow conveying paths, said assembly including a first and a second rotatable contacting electrode (2, 8) with the contacting electrodes being associated each with one of the conveying paths, and first contacting electrodes (2) abutting against the work pieces being conveyed in a first conveying path T', and being spaced from the second conveying path T" and second contacting electrodes (8) abutting against the work pieces being conveyed in the second conveying path T" and being spaced to the first conveying path T'. The assembly and the work pieces are brought into contact with the treatment liquid. The contacting electrodes comprise first and second segments (9, 10) each that are insulated against each other and that are contacted to a current source (5) in such a manner that electrolysis areas E are formed between the work piece (1) being conveyed on the first and second conveying paths T', T", respectively, and second segments (9) that are turned towards the first and second conveying paths T', T" respectively and are not contacting the work pieces (1).

26 Claims, 8 Drawing Sheets

DEVICE AND METHOD FOR ELECTROLYTICALLY TREATING FLAT WORK PIECES

DESCRIPTION OF THE INVENTION

Figure 1:
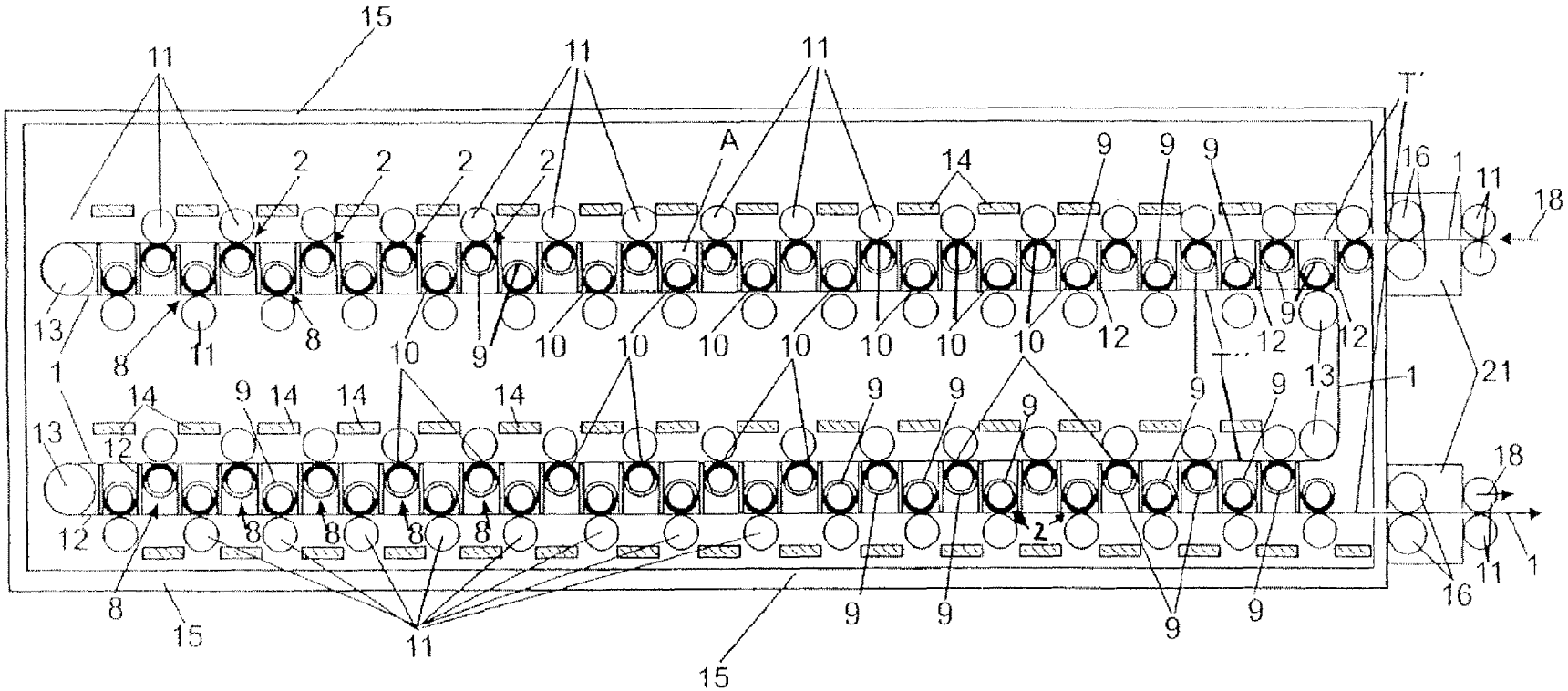

The present invention relates to a device and to a method for electrolytically treating flat work pieces, more specifically electrically conductive structures that are electrically insulated against each other on surfaces of work pieces formed into a flat shape, for example into a strip or board shape, in conveyorized lines.

For manufacturing chip cards (smart cards), price tags or identification tags for goods, foil-like plastics is utilized, the electrically conductive structures required for the electrical function desired being produced thereon.

Conventional methods utilize for example a copper coated material from which the desired metal pattern is produced using an etching process. In order to lower the cost of this method and to permit manufacture of structures finer than those that may be achieved with the etching process, there is an intention to produce the metal structures using electrolytic deposition. Such a known method for manufacturing antenna coils is described in U.S. Pat. No. 4,560,445. Then, the metal structure is produced on a polyolefin film using a method sequence involving the following method steps: swelling, etching, conditioning the plastic material for subsequent adsorption of catalytically active metal, depositing the catalytically active metal, printing a mask in the form of a negative image, accelerating the catalytically active connections, electroless and electrolytic metal plating.

Processes for metal plating strips include electroplating methods. For many years, what are termed reel-to-reel processing plants have been used for this purpose as conveyorized lines, the material being conveyed there through and brought into contact with the treatment liquid during transport. The strips are electrically contacted for electrolytic metal deposition. Contacting electrodes serve this purpose. For electrolytic treatment, it is possible to dispose either the two required electrodes, meaning the contacting electrode and the counter electrode, or the counter electrode only within the treatment liquid in the processing plants.

DE 100 65 643 C2 for example describes a device for electroplating or for electrolytically etching conductive strip-form work pieces in which both the contact rollers serving for establishing electrical contact and the counter electrode are disposed within the bath. The problem of such arrangements is that the contact rollers are also metal plated within the bath so that there is a risk that the metal deposited onto the contact rollers damages sensitive foils.

For the purpose of avoiding or reducing metal deposits on cathodes within the electrolyte bath, WO 03/038158 A describes an electroplating equipment for reinforcing by electroplating structures that have already been configured to be conductive on a substrate in a reel-to-reel equipment for strips in which an anode and a rotating contact roller are located in an electrolyte bath. On its side turned towards the substrate, the contact roller is connected to the negative pole of a direct current source and on the side turned away therefrom, to the positive pole of the current source. This is made possible by segmenting the contact roller in a manner similar to that of the collector of a direct current motor. As a result, the metal deposited onto the contact roller during one revolution of the roller during normal operation can be stripped off by changing the potential toward anodic. A major disadvantage of this method is that the metal removed from the anodically polarized contact roller must be removed from the machine at regular intervals as the layer deposited on the auxiliary cathode becomes ever thicker.

Another basic disadvantage is that only surfaces that are conductive over the entire area thereof may be electrolytically treated, structures which are electrically insulated against each other and are desirable for producing for example antenna coils however not.

DE 199 51 325 A1 therefore discloses a device and a method for the contactless electrolytic treatment of electrically conductive structures that are electrically insulated against each other on surfaces of electrically insulated foil material. The material is thereby conveyed on a conveying path through a processing plant while being brought into contact with the treatment liquid. During transport, the material is conducted past at least one electrode arrangement, each consisting of a cathodically polarized electrode and of an anodically polarized electrode, the cathodically polarized electrode and the anodically polarized electrode being in turn brought into contact with the treatment liquid. A current source causes current to flow through the electrodes and the electrically conductive structures. For this purpose the electrodes are shielded from each other in such a manner that substantially no electric current is allowed to flow directly between the two oppositely polarized electrodes. A disadvantage of the method described is that the layer of metal deposited can only have a reduced coating thickness since, as a result of the electrode arrangement, metal is deposited on the one hand but is also, at least in parts, dissolved again on the other hand as the work piece is conducted past the cathodically polarized electrode.

DE 100 65 649 A1 proposes a device for the electrochemical reel-to-reel processing of flexible strips having one conductive surface that has a cathodic contact roller located outside of the electrolyte. Special anode rollers around which the strips are wounded are rotatably disposed within the electrolyte. The anode rollers are thereby provided with an ion permeable, electrically insulating layer that keeps the strips spaced a defined and as small a distance as possible apart from the anode. It is not possible to treat surfaces having structures that are electrically insulated against each other though.

DE 44 13 149 A1 describes a conveyorized plating line for printed circuit boards in particular that comprises contact rollers and for example soluble anodes in the electrolyte, In order to avoid unwanted metal deposition onto the contact surfaces of the contact rollers providing rolling contact with the item to be metallized, contact sectors are provided on the contact rollers, said contact sectors being alternately cathodized or anodized through a commutator and providing cathodic contact with the item while being anodized in the region turned away from the item. As a result, self-stripping is achieved directly after unwanted metal deposition.

As a result, the known methods do not permit to electrolytically treat surfaces with small and very small structures that are electrically insulated against each other and that are for example deposited on an electrically insulated work piece in foil strip form cost-efficiently in strip processing or conveyorized lines.

The problem underlying the present invention therefore is to avoid the disadvantages of the known electrolytic processing devices and methods and more specifically to find a device and a method permitting continuous electrolytic treatment of electrically conductive structures that are electrically insulated against each other on surfaces of electrically insulating foil or board material in order to thus improve the known art. For this purpose, the device is to be of a very compact construction and to more specifically provide contacting elements so as to avoid the known problems related with an unwanted metallization of the contacting elements. More specifically, the method and the device are intended to be used for manufacturing foil material that is equipped with very small conductive structures and is employed as a component of chip cards that serve for example to mark and automatically identify and dispense goods in distribution stations or as electronic identity cards, e.g. for access control. Such type electronic components may be manufactured on an ultra large scale at very low cost. Further, the method and the device are to be utilizable for manufacturing printed circuit foils in the printed circuit technique and printed circuit foils having plain electric circuits such as for toys, in automotive engineering or in communications electronics. Further, the device and the method are to permit an increase in coating thickness.

The method and the device according to the invention serve to electrolytically treat more specifically small electrically conductive structures that are electrically insulated against each other on surfaces of electrically isolating flat work pieces or of fully conductive surfaces on flat work pieces, such work pieces preferably being in the form of strips or boards, more specifically of plastic strips (plastic foils) or chemical-resistant paper (e.g., resin-impregnated paper) provided with such conductive structures. Such type structures have dimensions of a few centimeters e.g., of 2-5 cm. Preferably, the device and the method serve to perform metallization processes as well as stripping processes (etching, slight etching) by accordingly changing the polarity of the segments with respect to the respective abutting work piece. For simplicity's sake, the description given herein after relates to metallization processes.

The device of the invention comprises a) at least two conveying paths that run substantially parallel to each other and on which the work pieces are preferably continuously conveyed in a respective direction of transport, with the structures on the work pieces being electrolytically treated, b) at least one assembly that is disposed between the conveying paths and that comprises a first rotatable contacting electrode and a second rotatable contacting electrode, with the first and second contacting electrodes being associated with a respective one of the conveying paths where they abut against the work pieces while being spaced from the respective other conveying path, with c) the first and second contacting electrodes comprising on the periphery thereof at least two segments each, that are insulated against each other and are connected to a current source, with d) a first segment of the first contacting electrode, which abuts against the work pieces being conveyed on a first conveying path, and a first segment of the second contacting electrode, which abuts against the work pieces being conveyed on a second conveying path, the first segments of the first and second contacting electrodes being connected to a first pole of the current source, and with a) a second segment of the first contacting electrode, which is turned towards the work pieces being conveyed on the second conveying path and is spaced from said second conveying path, and a second segment of the second contacting electrode, which is turned towards the work pieces being conveyed on the first conveying path and is spaced from said first conveying path, said second segments being connected to a second pole of the current source, so that electrolysis areas E for processing the work pieces are formed between the second segments of the first and second contacting electrodes and the work pieces, a current flowing there through said electrolysis areas, and b) the assembly and the work pieces being in contact with a treatment liquid.

It is to be understood that the term "assembly" as used herein is defined to be an assembly comprising a plurality of contacting electrodes which have the features b), c), d) and e) above. Accordingly any, construction will be understood to be covered by this invention wherein the device comprises one or more assemblies which each or at least one of them comprise two or more than two contacting electrodes having the above features.

The contacting electrodes have a conductive surface and are provided with, preferably divided into, segments in a manner similar to that of a collector in a direct current motor. The segments are insulated against each other preferably by insulating pieces. Electric current may be transmitted to the various segments by sliding contacts, reel contacts or mercury contacts.

Further electrically insulating partition walls may be provided between adjacent contacting electrodes in order to prevent or reduce direct current flow between the adjacent contacting electrodes. Further, the contacting electrodes are arranged closely side by side in order to be also capable of sufficiently contacting small-sized structures.

The contacting electrodes of an assembly preferably rotate at substantially the same speed. Synchronization means may be connected between the two contacting electrodes of an assembly for this purpose. Intermediate wheels in the form of gearwheels, cog belts, chains or the like, which connect the contacting electrodes, may be employed as the synchronization means.

The device according to the invention and the method are particularly characterized by the double function of the rotatable contacting electrodes: By polarizing simultaneously the contacting electrodes as the anode on the side turned towards the first conveying path and as the cathode on the side turned towards the second conveying path, metal that has unwantedly deposited on the contacting electrode when the side of the electrode for contacting the work pieces turned towards the second conveying path is cathodically polarized, will be stripped on the opposite side and deposited onto the work pieces when the side of the electrode turned towards the first conveying path serves as the anode. For this purpose, the work pieces are electrically connected to one (first) pole of a current source through the first segment of the first contacting electrode and through the first segment of the second contacting electrode which each abut against the work pieces on a respective one of the conveying paths. The second segment of the first contacting electrode and the second segment of the second contacting electrode, which are each turned towards the work pieces on the other respective conveying path, are electrically connected to the other (second) pole of the current source, and do not contact the work pieces being conveyed on these conveying paths. As a result, a current flows through electrolysis areas E for processing the work pieces which are formed between the second segments of the first and second contacting electrodes and the contacted work pieces. Hence, metal that is stripped off from the second segments will be deposited on the work pieces, the electrolysis areas E for this purpose forming respective electrolytic cells. As the contacting electrodes of the assembly rotate, the segments accordingly change polarity and accordingly first segments will be rendered second segments and vice versa. Metal will possibly be deposited on the previously cathodically polarized (first) segments and will be dissolved again if they are rendered anodically polarized to be the second segments, this resulting in the contacting electrodes of the assembly being self-stripping and the current used for stripping the contacting electrodes concurrently serving to metallize the work pieces. The advantageous double function of the contacting electrodes and the change in polarity of the segments of the contacting electrodes during rotation, depending on whether or not the segments abut against the work pieces during rotation, permits to prevent metal from accumulating on the contacting electrodes and from thereby disturbing the plating process.

This dispenses with both auxiliary electrodes for stripping the contacting electrodes and additional anodes. This makes it possible to provide a device of an efficient and compact construction permitting to achieve good coating thickness without major energy, material and maintenance expense.

For electrolytically processing the work pieces, metals such as copper, nickel, gold, silver, platinum, tin or alloys thereof may be deposited during metallization processes. If the work pieces are to be metal-plated, the potential of those segments of the contacting electrodes that abut against the work pieces or roll thereon (first segments) may for example be changed toward cathodic, whereas those segments that are not abutting against the work pieces but are spaced therefrom (second segments) are anodized As a result, a first electrolysis area is formed between cathodically polarized work pieces on the one conveying path and the anodized segments of the second of the two contacting electrodes of an assembly and a second electrolysis area is accordingly formed between the cathodically polarized work pieces on the other conveying path and the anodized segments of the first contacting electrode. If metal is to be electrolytically removed (stripped) from the work pieces, the segments are oppositely polarized accordingly.

In order to achieve efficient electrolytic treatment of the work pieces, a plurality of assemblies may be disposed between the conveying paths. A plurality of devices each having a plurality of assemblies may also be disposed in a row one behind the other and/or side by side (above each other) within a processing line. In order to improve guidance of the work pieces and more specifically to improve contact, additional conveyor reels may be provided opposite, for example directly opposite, to the contacting electrodes on the other side of the work pieces, said conveyor reels also rolling on the work pieces. A plurality of such type processing lines may be mounted in a row and the processing lines may comprise further stations such as dryer stations, storage stations for the work pieces, and others.

For processing, the surfaces of the work pieces are electrolytically treated on the side that is respectively turned towards the contacting electrodes. The work pieces, a plastic strip, chemical-resistant paper (e.g., resin-impregnated paper) or boards with small electrically conductive structures that are electrically insulated against each other for example, may be processed in the device in different ways. For example, different flows of work pieces may be processed on all the conveying paths with the direction of transport of the various flows being either the same or opposite. It is further possible to lead through the device and to process therein but one flow of work pieces, re-directing or transferring means, e.g., turn rollers or other re-directing or transferring devices being disposed in this case at respective return points of the device, said means serving to re-direct or transfer the work pieces from one conveying path to another, thus moving them on the forward route or on the return route past the contacting electrodes.

If the electrically conductive structures, that are electrically insulated against other structures on the same surface of the work pieces, are electrically connected to other structures being disposed on the respective opposite surface of the work pieces through through-plated holes provided in the material, the sides turned away from the contacting electrodes may also be electrolytically treated as the structures located on the distal side are thus electrically contacted through the through-plated holes. In this case, there are provided additional working electrodes e.g., further anodes (additional anodes) that are disposed on that side of the work pieces that are not turned towards the contacting electrodes. For processing both sides, both soluble and insoluble anodes may be used as the anodes.

If the structures are not plated through, the assemblies may also be arranged in such a way that the work pieces are conducted through the device on a plurality of conveying paths by means of re-directing or transferring means, with the conveying paths being located between the assemblies so that the work pieces may be processed on either side. In this case, in a particular embodiment, what are termed dummies e.g., metal boards or an endless metal strip, may be conducted past the assemblies of contacting electrodes and processed instead of the work pieces on the respective outer conveying paths, where no conveying path is provided for the work pieces. Said dummies are electrically contacted, thus constituting an anti-pole to the anodically polarized exterior segments of the contacting electrodes. Metal that has deposited on the dummies is either chemically etched away after the dummies have exited the device or, in the case of an endless metal strip for example, is electrolytically removed on the return route. For recyclability, the dummies preferably consist of stainless steel. This embodiment is appropriate where the work pieces are conducted between two adjacent assemblies which, in this implementation, use one conveying path in common (in order to process the work pieces on this conveying path).

The contacting electrodes may preferably also be utilized to convey the work pieces so that the complexity of the device may be further reduced by saving means that are only suited for transport such as conveying rollers or reels.

The spacing between the contacting electrodes should be selected to be so small that also very small electrically conductive structures, of e.g., 2-5 cm, may still be readily electrolytically treated, meaning supplied with current. If the spacing may no longer be reduced because of the chosen diameter of the contacting electrodes, these may also be nested within one another when viewed in the direction of transport of the work pieces. For this purpose, the insulation partition walls being disposed between the contacting electrodes may have a curved shape. The curved shape of the insulating walls also permits to reduce the number of collector-shaped segments on the contacting electrodes because the shielding effect provided by the insulating walls comprises a greater surrounding area. As a result, the sliding contact that supplies the counter electrode side with current may also be selected to have a larger size than the electrode side rolling on the work pieces so that the duration of the metallization process may be lengthened.

By arranging the contacting electrodes in this manner, it is possible to reliably metallize even very small structures that are electrically insulated against each other. The smaller the spacing between the adjacent contacting electrodes, the smaller are the differences in coating thickness in the end areas and the central areas of the structures (when viewed in the direction of transport). This is due to the fact that the structures are simultaneously contacted by the contacting electrodes and located in the electrolysis area only on a certain travel distance of the conveying path leading through the device of the invention. As far as the end regions are concerned, this provision only applies if the spacing between the contacting electrodes in the device is so small that the structures may always be electrically contacted by at least one contacting electrode as the work pieces are conveyed there through. This is only possible if the structures are quite large or if the spacing between the contacting electrodes is small. The spacing between the contacting electrodes should thereby be of a few centimeters at the most in order to permit, as far as practicable, uniform metallization of structures having dimensions of but a few centimeters.

In principle, a plurality of embodiments can be envisaged for realizing the afore mentioned principles. A particularly preferred first embodiment consists in that the work pieces are conveyed in the device in a horizontal direction of transport. In this case, the work pieces can be conveyed either horizontally or vertically or in an inclined orientation. The device comprises at least one aperture on the entrance side and one aperture on the exit side thereof, for example slots, to allow entrance and exit of the work pieces into and out of the device. To prevent too much treatment liquid from passing through the slots, sealing elements e.g., sealing rollers, may be provided on the apertures on either side of the conveying path. Further, there may be provided splash guards around the passage apertures and a collecting tank for the treatment liquid or a corresponding chamber beneath the passage apertures. The outflowing treatment liquid collects in the collecting tank and is returned to the device of the invention e.g., by means of suited pumps and pipelines.

In the device, a plurality of assemblies of contacting electrodes may be disposed in a row one behind the other. A very compact construction of the device, and as a result thereof, of the electrolysis areas is thus achieved.

The minimum size of the insulated structures to be processed is more specifically also determined by the minimum spacing to be achieved between the contacting electrodes. The minimum spacing depends, i.a., on the spatial dimensions of the contacting electrodes and on the spacing between the segments of the contacting electrodes and the work pieces in the electrolysis areas. It is therefore advantageous to configure the contacting electrodes as rollers having a small diameter so that it is possible to select the spacing between the longitudinal axes of the rollers or of the reel electrodes to be very small. The thus made possible compact assembly allows the electrolytic treatment of structures the dimensions of which are on the order of 2 cm or even less The object of reducing the minimum spacing between the electrodes using contacting electrodes of the smallest possible size, for example round, is often opposed to the problem of the resulting mechanical instability of the contacting electrodes, more specifically when using elastic contact materials. This problem may preferably be solved by mechanically stable contacting rollers having a metal axis.

When processing is performed on one side only, the contacting electrodes may contact the work pieces for example by means of a contact roller and of an opposing currentless roller (back-up or conveying roller).

Instead of the rollers and reels, rotating brushes or electrically conductive, sponge-like devices intended to wipe over the surface of the work pieces may be utilized as the contacting electrodes. The prerequisite thereof is the suited segmentation according to the invention and power supply to the discrete segments. Deformations of the brushes or of the conductive coatings are thereby not allowed to produce shorts with adjacent segments.

The contacting electrodes are pushed onto the surface of the work pieces with the assistance of the conveying reels and by gravity and/or by the force of a spring.

The device according to the invention may be disposed in a processing tank, that may comprise, at the inlet and outlet openings for the work pieces, sealing elements such as sealing lips and/or scrapers for confining the liquid in the processing tank thus forming an electrolysis apparatus. Squeezing rollers may further be provided, said rollers retaining the liquid, for example when the foil or the boards are being removed from the liquid, while reliably guiding the work pieces. Said sealing means serve to confine as completely as possible the liquid in the tank so as to prevent to the largest possible extent discharge of the treatment liquid. This is particularly important if the work pieces are to be conveyed horizontally in a vertical position because in this case pressure building up in the treatment liquid as a result thereof in the lower regions of the passage apertures is quite high. The work pieces may also be conveyed into the electrolysis apparatus from the above through the liquid bath level, especially if foil strip material is to be processed. Under these circumstances no inlet and outlet openings for the work pieces are provided at the side walls of the processing tank.

The contacting electrodes as well as working electrodes, e.g., additional anodes, are preferably elongate and may more specifically extend across the entire useful (to be treated) width of the work pieces, preferably substantially transverse to the direction of transport of the work pieces.

If board-shaped work pieces are to be processed in the line, transferring devices are provided instead of the turn rollers. A transferring device consists for example of conveying or guide reels disposed on either side of the conveying paths. A board coming from the one conveying path enters the transferring device which takes hold of it. As soon as the board has well entered the transferring device, said device pivots to the returning conveying path and releases the board. In order to prevent the intervals between adjacent boards on the conveying path from being too large, the transferring device may perform, for example in addition to an up and down movement between the conveying paths, a forward and return movement. The forward and return movement is selected to be so large that the spacing between the boards after transfer corresponds to the spacing before the transfer. If the board-shaped work pieces are only to be coated on one side, the transferring device may also perform a combined rotation and forward/return movement so that after the work piece has changed direction it has the side to be processed being previously been turned downwards will then be turned upward towards the segmented contacting electrodes.

Roller-shaped contacting electrodes may preferably be made from an elastic, conductive material. As a result, on the one side a very high current may be transmitted onto the surface of the work pieces and on the other side the spacing between the contacting electrodes and between the contacting electrodes and the electrolysis areas will be reduced since the contact surfaces between the electrodes and the surface of the work pieces that determine this spacing are not narrow elongate surfaces like on rigid rollers but wider surfaces.

Metal/plastic composite materials, more specifically composite materials formed from an elastic plastic having a high fraction of electrically conductive fillers can be used as the elastic material for the contacting electrodes. They consist of elastomers as the binder, like rubber, silicone or other elastic plastic materials that are electrochemically stable, and of an electrically conductive filler. The binders also include not fully curing conductive glues as they are used in electronics manufacturing. The electrically conductive filler is blended with such type materials during manufacturing. The metal/plastic composite is thus obtained.

The fillers, which are also termed interstitial components, preferably consist of metal in the form of powders, fibers, needles, cylinders, balls, flakes, felt and other forms. The percentage of filler that can be included in the entire contact material may be up to 90 weight %. As the percentage of filler increases, the elasticity of the metal/plastic composite diminishes, but the electric conductivity increases. The two-variables are adapted to the specific application. Any electrochemically stable material that is electrically conductive at the same time is suited for being used as the filler. Current fillers are for example titanium, niobium, platinum, gold, silver, stainless steel and electrocoal. Platinum-plated, silver-plated or gold-plated particles such as balls made of titanium, copper, aluminum or glass can also be used for example.

In a particular embodiment of the invention, the segments of the contacting electrodes may comprise boundary lines that are inclined at an angle $\alpha>0$ to the axis of the electrode and are also oriented at an incline with respect to the direction of transport of the work pieces. With this provision, a shielding effect produced by the intervals between the segments, for example by insulating pieces in the intervals, will not be transferred to certain regions on the work pieces but will be evened out. This results in uniform metal deposition during metallization. Moreover, the angle a of the boundary lines may also have different values on one or more segments of a contacting electrode. The boundary lines may for example be configured in the form of a zigzag line.

In order to reliably provide a particularly compact construction, the contacting electrodes can be accommodated as compact assemblies on a common carrier frame.

The device according to the invention is preferably a component part in strip processing lines, each comprising at least one first and one second storage means for storing the work pieces, for example storage drums (Reel-to-Reel). Further, such type processing lines often comprise conveying members for conveying the work pieces through the processing line from the at least one first storage means to the at least one second storage means. Additionally, means for guiding sensitive work pieces so that they keep a precise straight course, for example lateral bounding reels, and means for modifying the position of the conveying rollers may be provided. For this purpose, sensors may be provided along the conveying path, said sensors continuously registering the position of the outer edge of the work pieces and modifying the means for conveying and/or guiding the foil upon detection of non-permissible differences.

The device. is more specifically suited for depositing metal on thin work pieces in strip form such as foils. Such type foils may for example consist of polyester, polyamide or polyolefin, more specifically of polyethylene.

The device as claimed may more specifically be utilized for manufacturing coil shaped structures on plastic foil material. Such type coil shaped structures may be used as antennas that are utilized for contactless data transmission on a data carrier (smart cards): Carriers comprising such type antennas may for example carry an integrated circuit that is electrically wired with the antenna so that electric pulses generated in the antenna are sent to the integrated circuit where they are stored for example or the data received by means of the antenna are processed as an electrical signal. Signal processing permits to convert the data supplied, taking for example into consideration other data already stored, the thus obtained data being in turn stored and/or delivered to the antenna. These data, which are then transmitted by the antenna, can be received in a receiving antenna so that the data emitted may for example be compared to the data received by the antenna on the data carrier. Such type data carriers may for example be utilized in goods logistics and in retail trade e.g., as contactless readable price tags or identification tags on goods, further as person related data carriers such as skiing cards, RFID (Radio Frequency Induced Device) tags and identity cards for access control or as identification means for automotive vehicles.

Further application fields of the foils provided with the electrically insulated metal structures are for example the manufacturing of simple electric circuits such as for toys or wrist watches, in automotive engineering or in communications electronics. These materials may further be utilized for active and passive electromagnetic shielding of apparatus or as shielding grid materials for buildings as well as on textiles for clothing.

The data carriers can be made from foils such as polyester foils or polyvinyl chloride foils, on which the electrically insulating structures have been electrolytically produced, using the device according to the invention. For this purpose, the foils provided with metallized structures and manufactured using the device are divided, according to the structure patterns produced thereon in multiple printing, into discrete foil pieces corresponding to the size of the respective data carriers. The integrated circuits may then be applied onto the foil pieces and the metal structures electrically connected to the integrated circuit applied A bonding process may more specifically be utilized for this purpose. The integrated circuits can be applied not only in the form of a chip that has not yet been provided with a carrier and eventually housed, but may also be applied onto a carrier such as a TAB carrier (TAB—Tape Automated Bonding) and placed onto the foil. Once the integrated circuit has been electrically contacted, the foil piece can be processed into the finished data carrier, said piece being further laminated with another foil for example so as to form a card with the antenna being welded therein.

More specifically, the electrically insulating structures on the data carrier can be manufactured in the following manner:

The foil material, which is preferably in strip form and has for example a thickness ranging from 20-50 μm and a width of 20 cm, 40 cm or 60 cm, is provided on a storage drum around which the foil is wound.

At first, the strip is provided with the structure to be produced in that an activator varnish or an activator paste is printed onto the surface of the foil for example. For this purpose, said varnish or paste may for example contain a noble metal compound, more specifically a palladium compound, preferably an organic palladium complex. The varnish or paste moreover contains a binder as well as further current constituents such as solvents, dyes and thixotropic agents. The varnish or paste is printed preferably by means of a roller onto the foil conducted past said roller, more specifically with an offset, an intaglio or a lithographic printing process but also by screen printing or by reel-to-reel screen printing. For this purpose, the varnish or paste is transferred from a reservoir onto a dispenser roller, from the dispenser roller onto the printing roller and from there onto the foil. Excess varnish or excess paste is removed from the dispenser roller and from the printing roller using suited scrapers. The printing roller may for example be coated with hard chromium. The foil is pressed against the printing roller by means of a soft counter roller ("soft roller") for efficient inking. In a station following the activator printing station, the ink printed on the foil is dried. For this purpose, the strip form foil material is conveyed through a drying path that is for example formed from IR radiators or hot air blowers or that may also comprise UV radiators if the binder in the activator varnish or the activator paste is to dry reactively under the action of UV radiation (preferably without solvent), These drying apparatus are preferably disposed in a drying tunnel through which the strip form material is conveyed. After having passed the drying station, the strip form material reaches another strip storage facility that may more specifically be formed from a drum. On its way from the first storage drum from which the material is unwound to the second drum on which the material is recollected, said material is guided and stretched over reels (reel-to-reel method).

The strip form foil that has been printed with the activator varnish or with the activator paste is next electrolessly and/or electrolytically metal plated in order to form the metal structures.

For this purpose, the foil that has been printed with the activator varnish or paste is unwound from the storage drum and conducted through various consecutive processing stations of a processing line, the strip form material being guided over turn rollers and stretched (reel-to-reel method). In principle, it is also possible to convey the strip form material directly from the printing process to the wet-chemical treatment without any further intermediate storing of the material.

In a first treating step the printed material is transferred into a reducer that usually is a strong reducing agent in an aqueous solution such as sodium boron hydride, an amino borane such as dimethyl amino borane or a hyppphosphite. In the reducer, the oxidized noble metal contained in the varnish or the paste is reduced to metallic noble metal, for example to metallic palladium. After reduction, the strip is fed to a rinsing station where excess reducer is water rinsed. A spray rinsing station is preferably utilized for this purpose. Next, a very thin layer of copper (of 0.2-0.5 μm thick) is electrolessly deposited onto the activator structures. Copper deposition onto the structures is initiated by the noble metal nuclei formed in the reducer, no copper being deposited onto the non printed areas. A current bath containing formaldehyde as well as tartrate, ethylene diamine tetraacetate or tetrakis-(propane-2-ol-yl)-ethylene diamine may be utilized as the copper bath. After copper plating, the strip form material is conveyed to a rinsing station in which excess copper bath is stripped off by spray rinsing with water.

Next, the strip form material is fed to the device according to the invention in which the now electrically conductive structures are selectively coated with further metal, such as copper. Preferably, copper is deposited. Any known electrolytic copper plating baths can be used for electrolytic copper deposition, for example baths containing pyrophosphate, sulfuric acid, methane sulfonic acid, amido sulfuric acid or tetrafluoroboric acid. A particularly suited bath is a sulfuric acid bath that may contain copper sulfate, sulfuric acid and small amounts of chloride as well as additives such as organic sulfur compounds, polyglycolether compounds and polyvinyl alcohol for example. The sulfuric acid bath is preferably operated at a temperature near room temperature at as high as possible a cathodic current density. If a cathodic current density of for example 10 $A/dm^2$ (active structure surface) will be selected, copper will be deposited at a rate of about 2 μm/min. With a line of about 2.5-7.5 m in length, a copper layer of from 5-15 μm thick can be deposited, if the speed at which the foil strip is conveyed through the device according to the invention is 1 m/min, while the work pieces passing through once. The line may be shortened accordingly or metal may be deposited so as to provide greater coating thickness if the material is conveyed several times through the device.

Electric current can be supplied to the work pieces and to the electrodes in the device in accordance with the invention in the form of direct current. In a particular embodiment, pulsed current may also be used. Pulsed current is advantageous for producing as high a current density as possible since a metal layer e.g., a copper layer, exhibiting good properties (high surface quality such as gloss, lack of roughness, uniform coating thickness, good ductility, electric conductivity) can also be deposited under these conditions. For this purpose, what is termed reverse pulsed current is preferably utilized, i.e., a pulsed current that comprises both cathodic and anodic current pulses. In principle, unipolar pulsed current is of course also advantageous. Using reverse pulsed current, the pulse heights of the cathodic and anodic current pulses, the respective pulse widths and at need the interpulse pauses between the individual pulses as well are optimized in order to optimize the deposition conditions.

If copper is deposited, compounds of a redox system, more specifically $Fe^{2+}$ and $Fe^{3+}$ compounds such as $FeSO_4$ and $Fe_2(SO_4)_3$ are preferably added to the bath in order to maintain the concentration of copper ions in the deposition solution when insoluble anodes are used. The $Fe^{2+}$ ions contained in the bath oxidize at the insoluble anodes to form $Fe^{3+}$ ions. The $Fe^{3+}$ ions are transferred to metallic copper pieces, preferably being contained in another tank containing the metallic copper pieces (regenerating tower). In the regenerating tower, the copper pieces oxidize under the action of the $Fe^{3+}$ ions to form $Cu^{2+}$ and $Fe^{2+}$ ions. As the two reactions (anodic oxidation of the $Fe^{2+}$ ions to form $Fe^{3+}$ ions and oxidation of the copper pieces to form $Cu^{2+}$ while forming $Fe^{2+}$ ions) proceed concurrently, the concentration of copper ions in the deposition solution can be kept largely constant.

After the foil strip has been passed through the device according to the invention during a metallization process, the material is again conducted to a spray rinsing station in which excess deposition solution is rinsed off. Then, the strip material may be transferred to another station of the processing line in which it will be contacted with a passivation means that is intended to prevent copper from tarnishing. Prior to winding the strip form foil material onto another storage drum, the material is dried in a drying station. For this purpose, the apparatus utilized may be similar to those used for drying the activator varnish or the activator paste.

The stations utilized for performing the method steps mentioned may be equipped with suited guide and conveying reels or rollers as well as with apparatus for processing the treatment liquids such as filter pumps, dosing stations for chemicals, as well as with heating and cooling systems.

Figure 2:
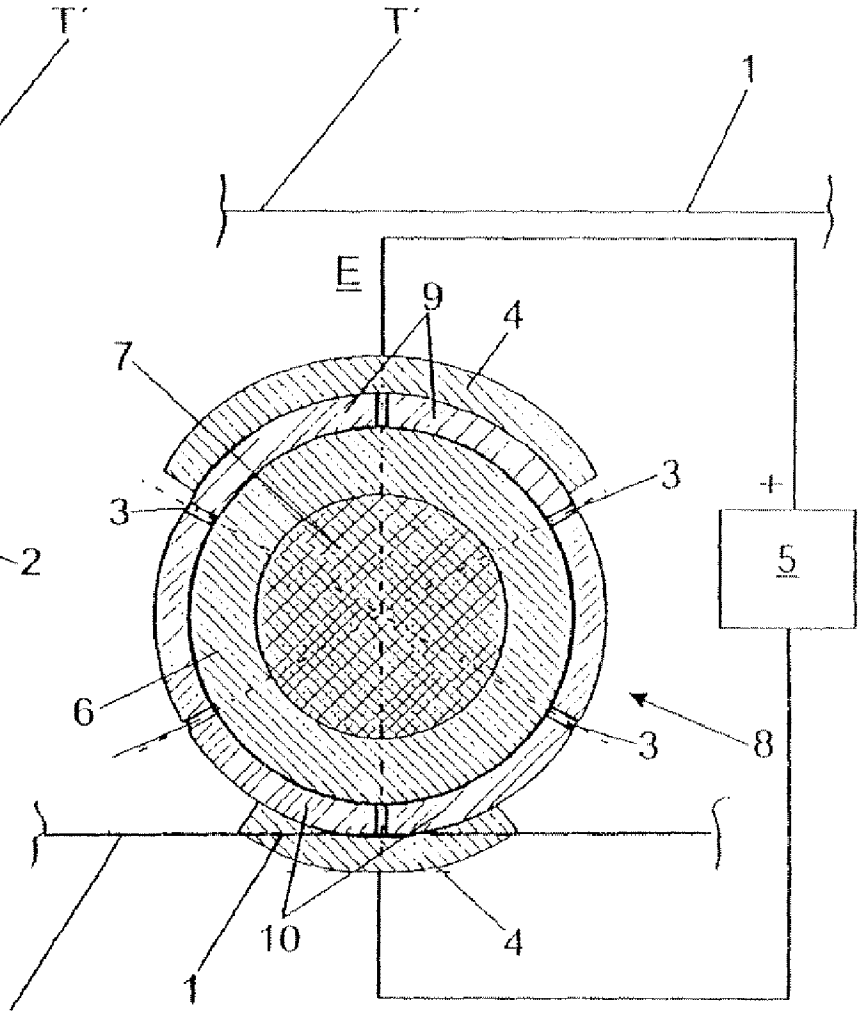
Figure 3:
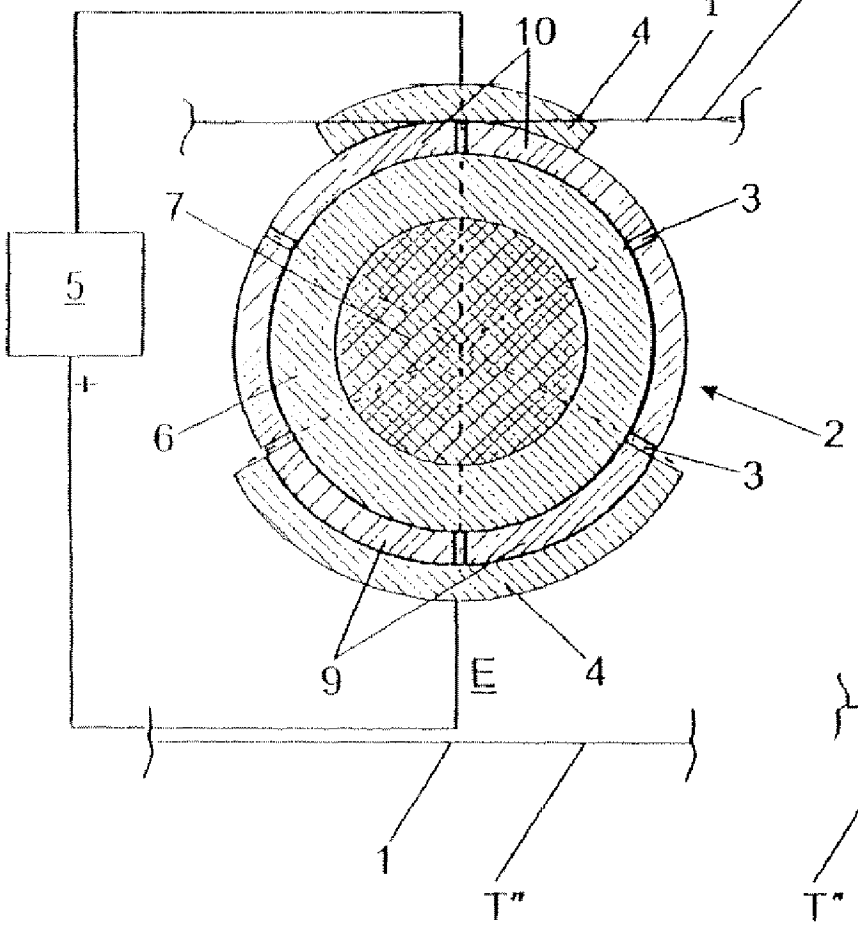
Figure 4:
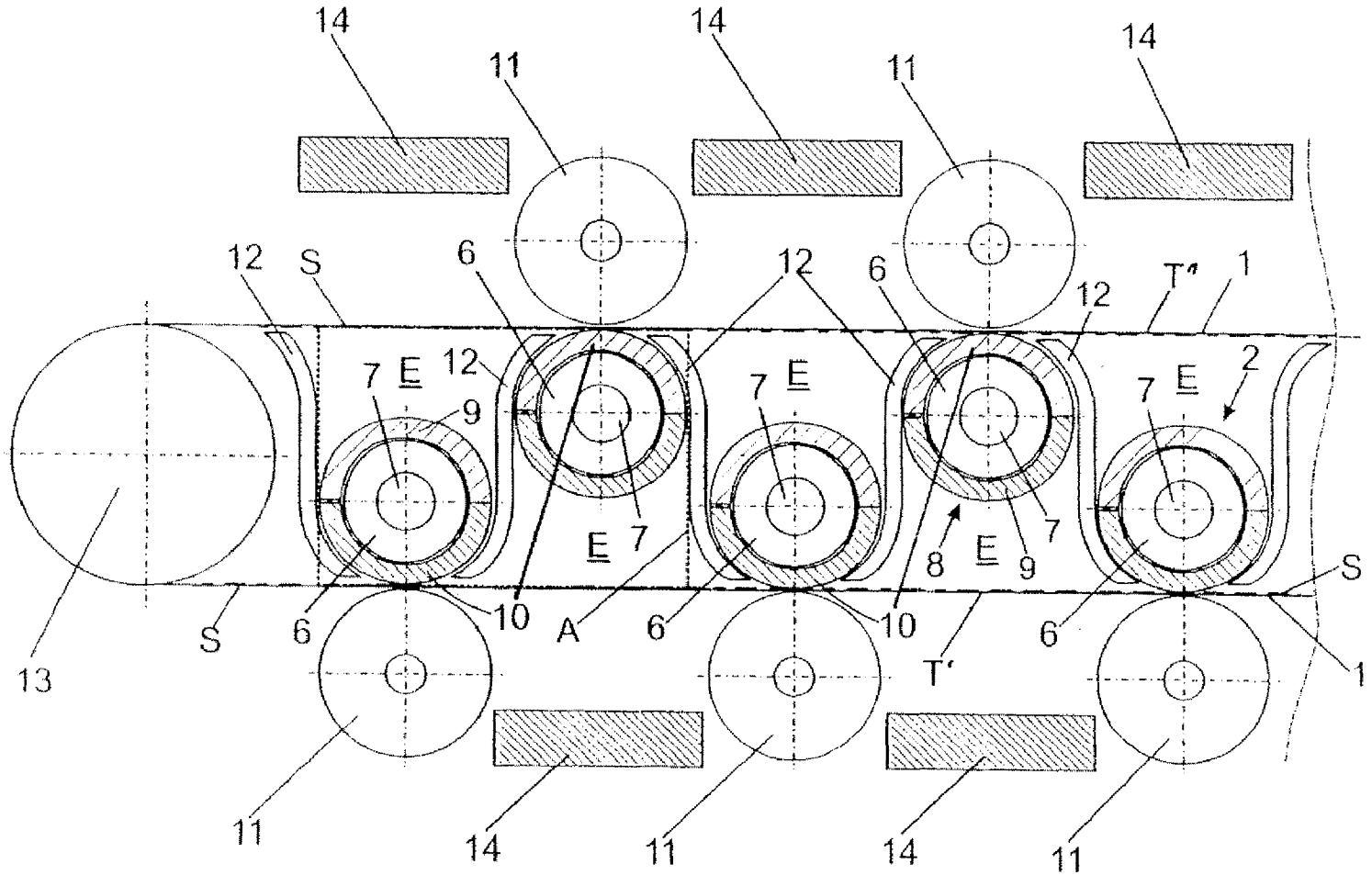
Figure 5:
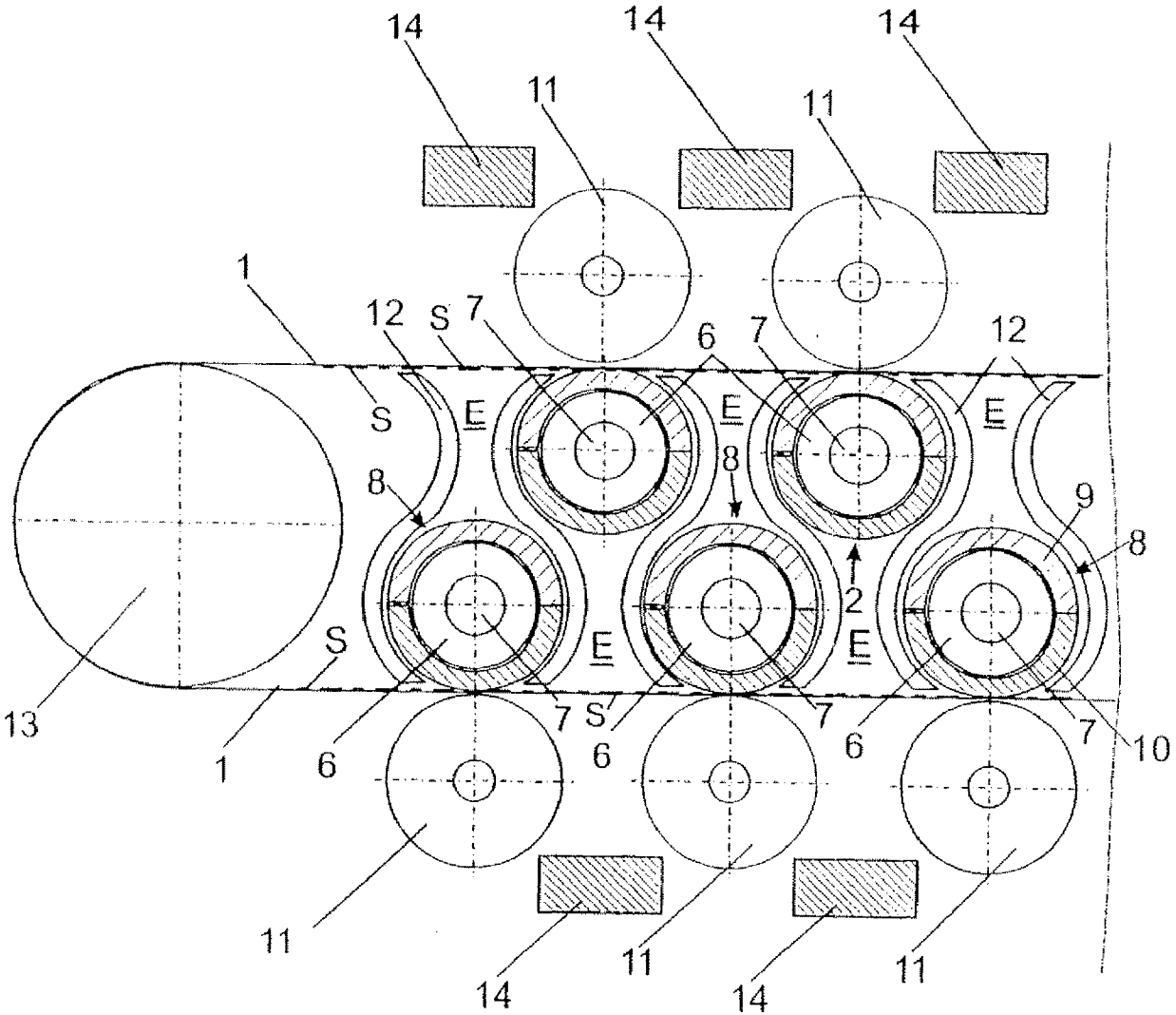
Figure 6:
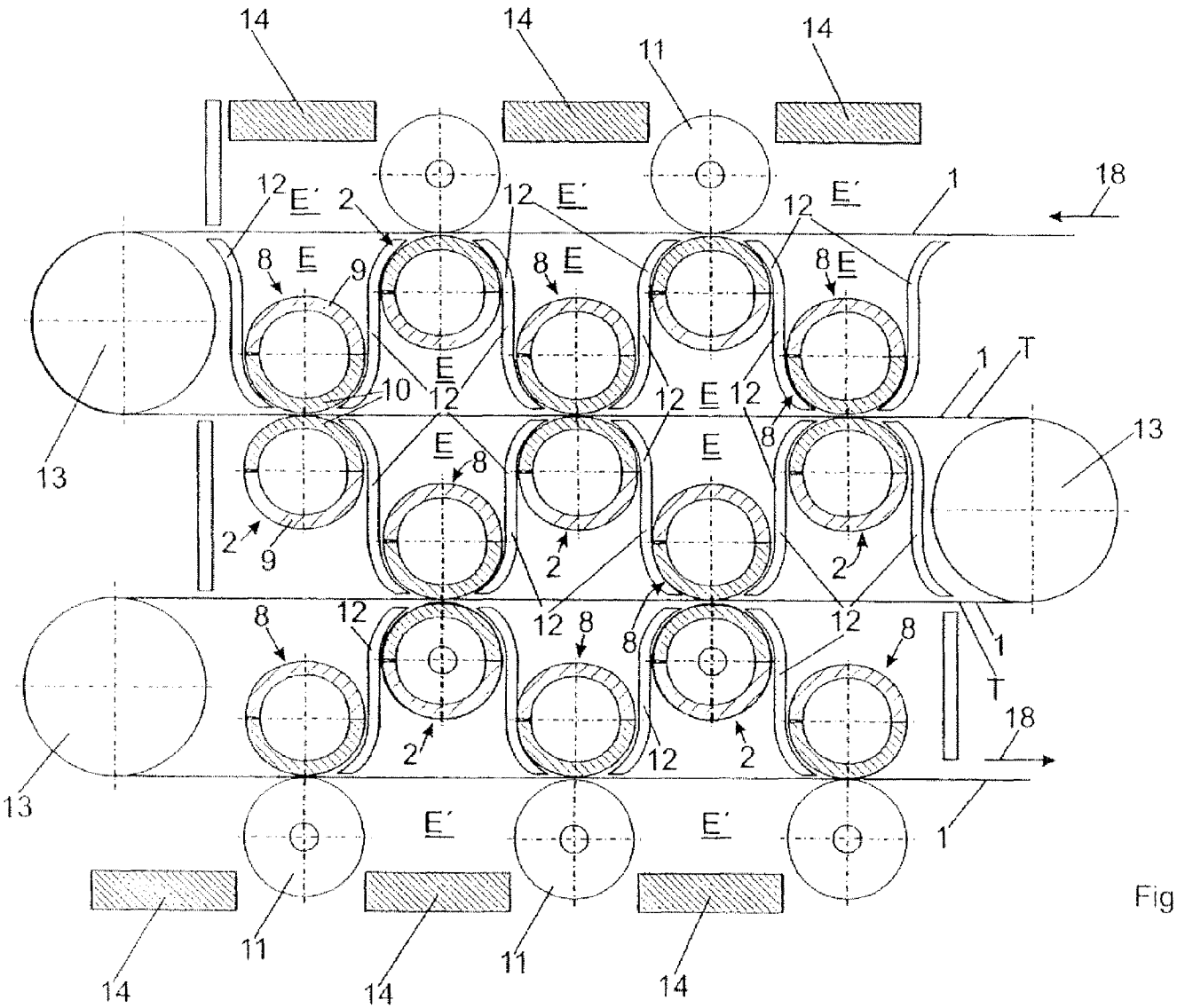
Figure 7:
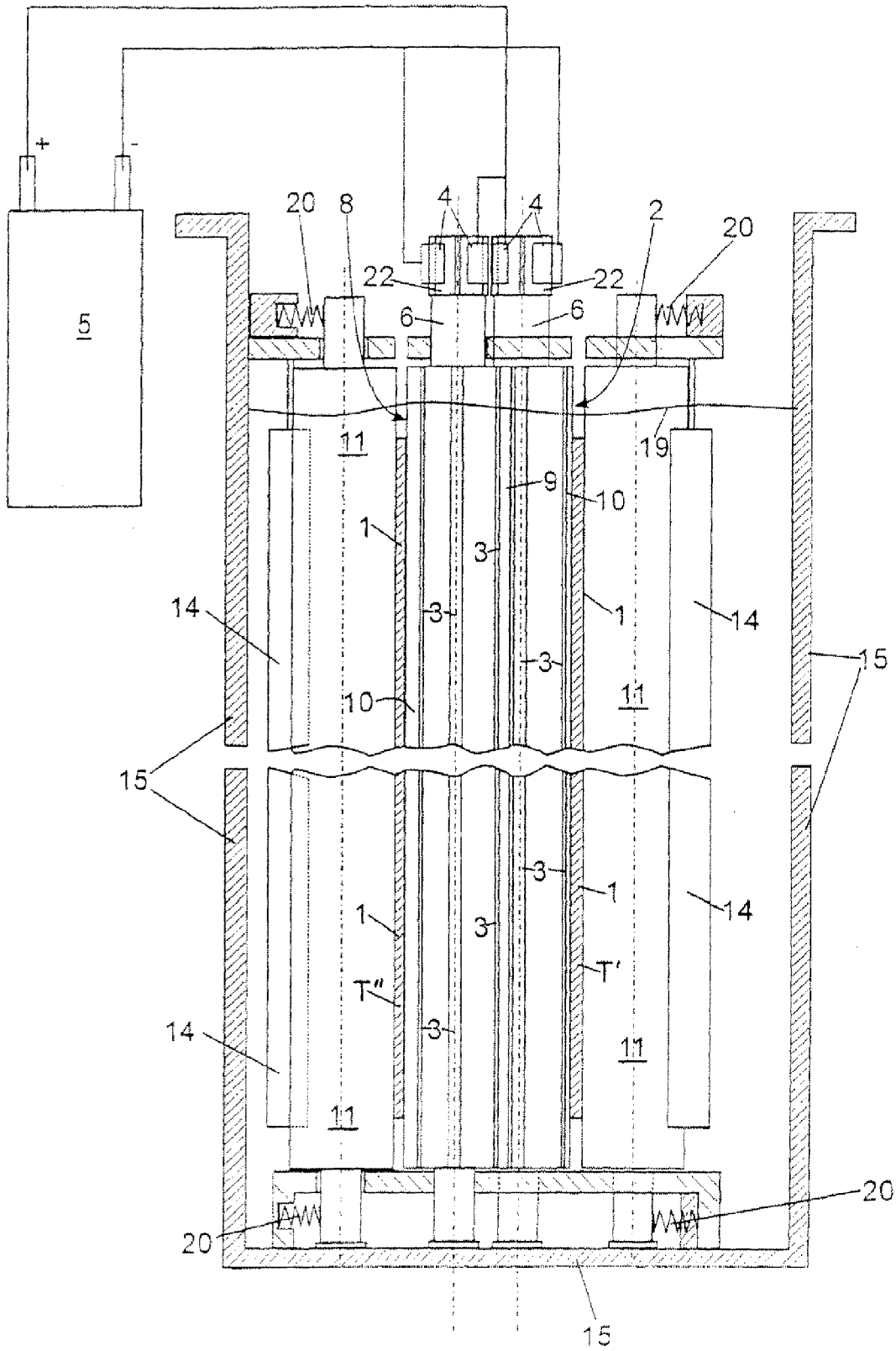
Figure 8:
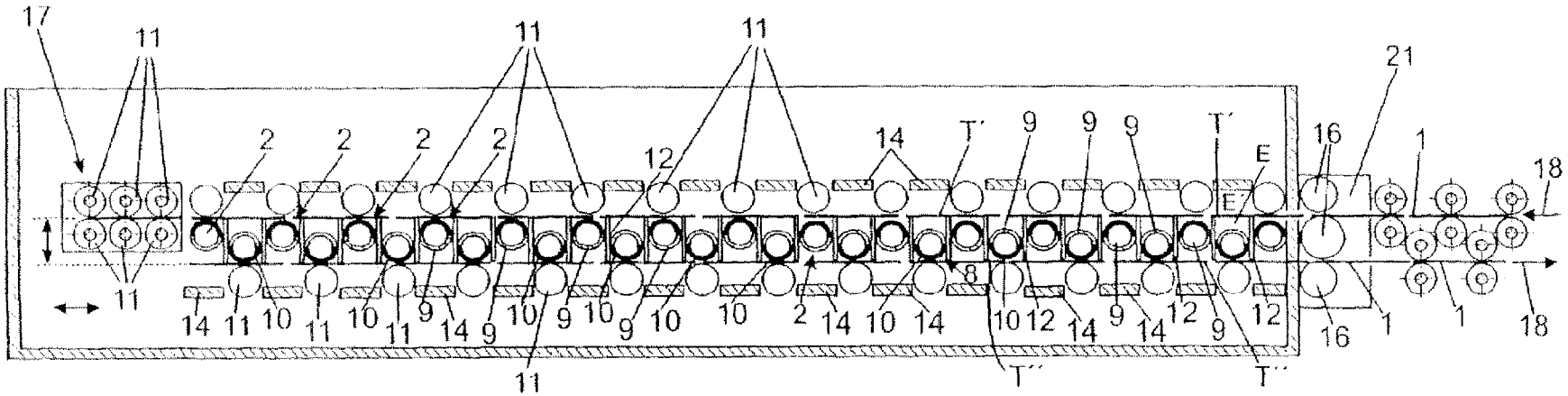
Figure 9:
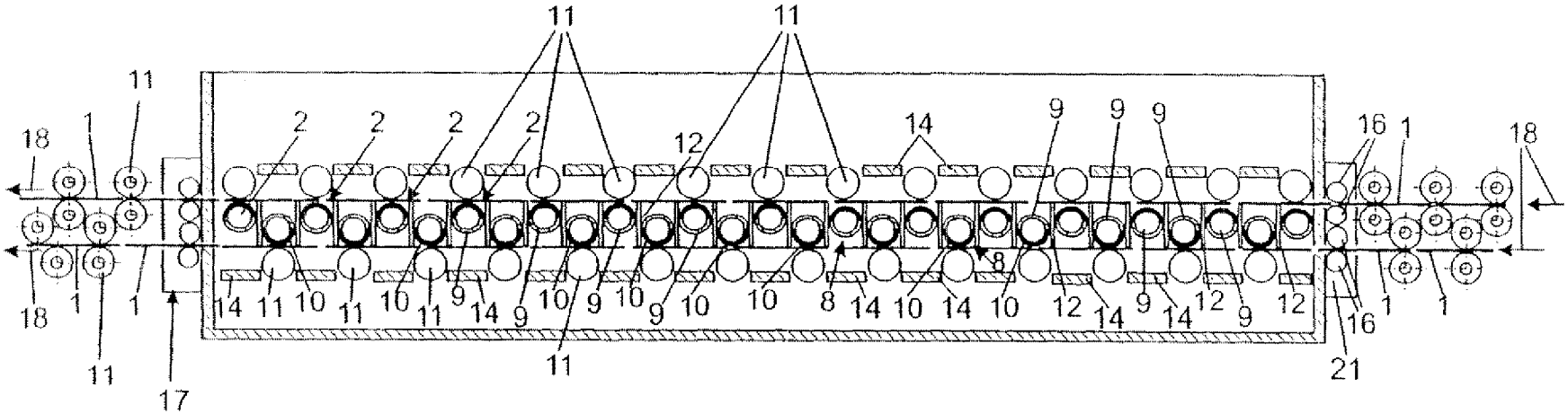
Figure 10:
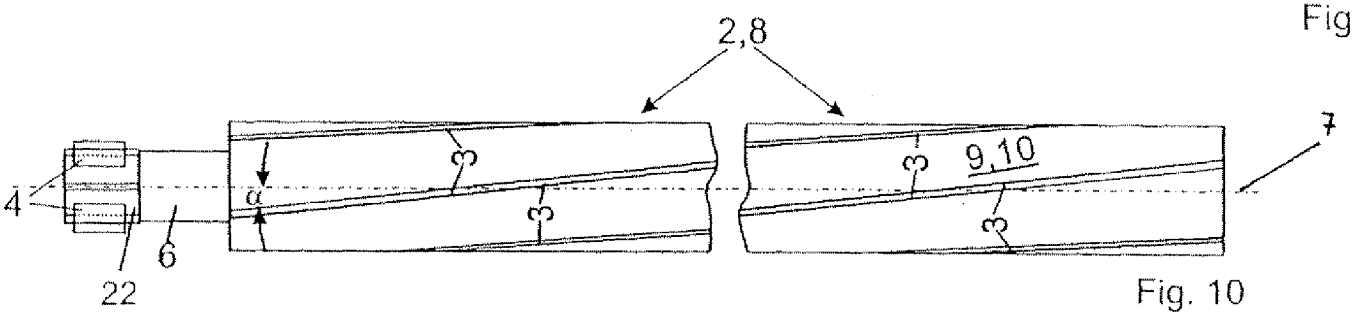
Figure 11:
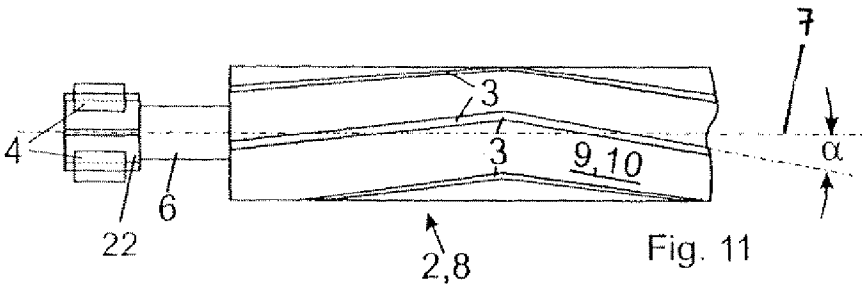

The invention will be explained with reference to the following Figs. The various Figs. show:

FIG. 1 a top view of a device according to the invention for electrolytically coating work pieces;

FIG. 2 a cross sectional view through a device according to the invention for a first segmented contacting electrode of the assembly;

FIG. 3 a cross sectional view of a second contacting electrode of the assembly in accordance with FIG. 2;

taken together, the FIGS. 2 and 3 illustrate an assembly in terms of the present invention;

FIG. 4 a device according to FIG. 1, but with specially shaped insulating walls between the contacting electrodes;

FIG. 5 another embodiment of the invention according to FIG. 4 with insulating walls of a particular shape for treating particularly small structures;

FIG. 6 a device according to the invention having a very compact construction similar to FIG. 1 for uniform deposition of metal on either side of the work pieces;

FIG. 7 a front view (with the bath tank cut away) of a device according to the invention with vertical orientation of the work pieces and horizontal direction of transport;

FIG. 8 a side view of a device according to the invention for electrolytically treating board-shaped work pieces on either side;

FIG. 9 a side view according to FIG. 8 with the work pieces being conveyed in the same direction of transport on both conveying paths;

FIG. 10 a contacting electrode of the device with a particular implementation of the segments:

FIG. 11 another implementation of the segments similar to FIG. 10.

In the FIGS., like numerals are used to denote like elements.

FIG. 1 is a top (or side) view of a device according to the invention with two rows of assemblies A of contacting electrodes arranged side by side between two respective conveying paths T', T", said assemblies comprising first contacting electrodes 2 and second contacting electrodes 8. The device further comprises a current source (not shown) and a processing tank with walls 15 comprising apertures in the form of slots for the passage of the work pieces 1 provided at the entrance and the exit site thereof. The work piece 1 is a foil strip having for example insulated, conductive structures printed on either side thereof. The sealing rollers 16 prevent major liquid loss from the tank. The liquid loss is collected in the chamber 21 at the exterior side of the tank and is returned to said tank through pumps and pipelines that have not been illustrated herein. The work pieces 1 are conducted in the direction of transport 18 into, through and out of said tank. Further, additional anodes 14 and turn rollers 13 for redirecting the work pieces 1 from one conveying path T' to another one T" within a row of assemblies A and between two rows of assemblies are located within said tank. Back-up or conveying reels or wheels 11 for conveying the work pieces 1 are disposed alongside, or on either side of the conveying path for the work pieces 1. These may be insulating reels or wheels, for example steel reels provided with a rubber-like coating. As the first and second contacting electrodes 2, 8 are disposed in very close proximity to each other, they are separated from each other by insulating walls 12 when viewed in the direction of transport 18 in order to prevent a major amount of current from flowing directly from the second contacting electrode 8 to the first contacting electrode 2 as this would result in the cathodically polarized side of the adjacent contacting electrodes being coated instead of the work pieces 1 or in a short being possibly produced.

A first turn roller 13 that reverses the direction of transport of the work pieces 1 within a row of assemblies A is located farthest from the entrance site of the work pieces, so that opposite directions of transport (forward and back) are obtained within one row of assemblies. Second contacting electrodes 8 are offset with respect to the first contacting electrodes 2 along the opposite direction of transport. The contacting electrodes 2, 8 each comprise two oppositely polarized segments 9, 10 (merely schematically outlined in FIG. 1 with black and light areas at the contacting electrodes), with one first pole of the current source contacting a respective one of the first segments 10 of the contacting electrodes 2, 8 abutting against the work pieces in the conveying paths T', T" so that the work pieces are electrically contacted and with the other second pole of the current source contacting the second segments 9 of the contacting electrodes 2, 8 that are turned towards the work pieces in the conveying paths T', T" and spaced to said conveying paths so that electrolysis areas E are formed between the second segments 9 of the contacting electrodes 2, 8 that are spaced from the work pieces and the work pieces in the conveying paths.

The second segments 9 of the contacting electrodes 2, 8 comprise the same polarization as the additional anode 14 so that further electrolysis areas can be formed when the work pieces are plated through. By means of the turn rollers 13, the work pieces are conducted several times back and forth through the device with both surfaces of the work pieces 1 being processed to the same extent. In proximity to the entrance and to the exit side of the tank there are provided turn rollers 13 for re-directing the work pieces 1 between two rows of assemblies A. At the end of the second row of assemblies, the work pieces are caused to exit the tank at the sealing rollers 16 and are conducted e.g., to other processing stations such as rinsing or drying stations.

By re-directing the work pieces 1 several times, a long processing path on which thicker coatings may also be readily achieved is made available within a small space.

From FIGS. 2 and 3 it can be seen that the contacting electrodes 2 and 8 are divided into six segments 9, 10 each. The segments are fastened to an insulating ring 6 which in turn is rigidly seated on the axis 7. The axis 7 can be made of metal for strength. The individual segments 9, 10 are electrically insulated against each other by means of insulating pieces 3. Electric current is supplied to the segments 9, 10 of the contacting electrodes through respectively cathodically and anodically connected shoes 4. Said shoes 4 are arranged in such a manner that, in the event of a metallization process, the current always flows from the negative pole of the current source 5 to the first segments 10 in the immediate proximity to the surface being in touching contact with the work pieces 1. As a result, the work pieces 1 are electrically contacted cathodically. The positive pole of the current source 5 is connected to the opposing second segments 9 that are turned towards, and spaced from, the to-be-processed structures on the work pieces 1 being on their return route on the other respective conveying path of the assembly without being in touching contact with the work pieces there. An electrolysis area E is formed between the second segments 9 and the work pieces 1. Discrete electrolysis areas E form one after another as a result of this segmentation and of the special current supply to the segments 9, 10 through the shoes 4, with the second segments 9 of the contacting electrodes 2, 8 forming the anode and the opposite work pieces (which are each contacted by the first segments 10 of the contacting electrodes 2, 8) forming the cathode. Taken together, the two FIGS. 2 and 3 show an assembly in accordance with the present invention.

Even if insulating walls are disposed between the contacting electrodes, a smaller amount of metal may possibly be deposited onto the first segments 10 if the latter are cathodically polarized. But since, as the contacting electrodes 2, 8 rotate further, the potential of these first segments i0 changes toward anodic so as to form anodic second segments 9 vis-á-vis the opposing work pieces 1 exhibiting cathodically polarized metallic structures, the metal deposited is immediately dissolved again and is deposited onto these work pieces 1. As a result, expensive stripping of the cathodically connected contacting electrodes that are constantly in contact with the treatment liquid (conductive electrolyte) is not necessary. Moreover, the current used to dissolve the metal is employed to deposit metal onto the work pieces 1.

FIG. 4 shows the electroplating line according to FIG. 1, however with specially shaped insulating walls 12 between the contacting electrodes 2, 8 of the device of the invention, so that metal deposition is accelerated as a result of the thus made possible higher current densities. The segments 9, 10 are merely outlined schematically. An assembly of two contacting electrodes 2, 8 is schematically outlined at A. The structures S to be metallized are electrically contacted through the contacting electrodes via the cathodically polarized first segments 10 and extend simultaneously into the electrolysis area E. There, they are electrolytically metallized. To metallize the side of the work pieces 1 that is turned away from the assembly A, there are further provided additional anodes 14 that are also connected to a current source (not shown). A current flow between said anodes 14 and the work pieces 1 can only be generated when the work pieces 1 are also contacted on that side. In the present case, this is brought about by an electrically conductive connection established from the electrically contacted side turned towards the assembly A (through-plating).

Further, there are provided back-up and conveying reels 11 that are either driven (conveying reels) or non-driven (back-up reels). In the last case, the contacting electrodes 2, 8 are driven and serve themselves as conveying reels.

FIG. 5 shows another example which corresponds to FIG. 4 with the insulating walls 12 having a particular shape and serving to process particularly small structures. The particular shape of the insulating walls as implemented permits to also sufficiently contact very small structures. In this example, the insulating walls 12 are twined about the contacting electrodes 2, 8. As a result, the spacing between adjacent contacting electrodes 2, 8 may be further reduced. Since the spacing between two cathodic first segments 10 is narrowed, structures of less than e.g., 2.5 cm in length as viewed in the direction of transport can still be sufficiently contacted if the contacting electrodes have small diameters of e.g., 3 cm, with the first and the second contacting electrodes 2, 8 mutually overlapping.

FIG. 6 shows a particular embodiment of the device in accordance with the invention similar to FIG. 1. This device serves to uniformly deposit metal on either side of the work pieces with the additional anodes 14, which in FIG. 1 are disposed between the two rows of assemblies, being eliminated. It illustrates a very compact embodiment of the device according to the invention for coating structures that are insulated against each other on the work pieces 1 on either side thereof including the through-plated bores. The device comprises three rows of assemblies. The one row of assemblies, which is formed between the two outer rows has no conveying path of its own associated therewith but uses instead the conveying paths T of the adjacent assemblies located outside. In principle and in accordance with the present invention, there are to be distinguished the portions T' and T" of the conveying path T but this is not shown herein for a better understanding of the FIG.

On the entrance side and on the exit side of the work pieces 1 electrolysis areas E are formed on either side of the conveying path between the work pieces 1 contacted by the first segments 10 of the contacting electrodes 2, 8 on the one hand and the additional anodes 14 and the second segments 9 of the contacting electrodes 2, 8, respectively, on the other hand, After the first re-direction one first contacting electrode 2 and one second contacting electrode 8 are always located opposite each other, with their first segments 10 cathodically contacting directly the two sides of the work pieces 1. The gaps at the respective sides thereof form the electrolysis areas E between the contacted work pieces 1 and the second segments 9 of the adjacent contacting electrodes 2, 8. The electroplating current is allowed to flow from the opposing anodically polarized second segments 9 of the contacting electrodes 2, 8 to the work pieces 1.

FIG. 7 shows a sectional front view (with the bath tank cut away) of a device according to the invention with vertical orientation of the work pieces 1 that are conveyed through the device on two conveying paths T', T" and in a horizontal direction of transport. The walls 15 form the tank that comprises in the front wall that has not been illustrated apertures for the passage of the work pieces 1 into and out of the tank. The passage apertures are almost completely closed by sealing rollers that are not shown in this illustration either. The treatment liquid escaping from the entrance and exit apertures is collected beneath the sealing rollers and returned to the processing tank through pipelines, pumps and possibly provided nozzle systems that have not been illustrated herein either so that the bath level in the tank, which is illustrated by line 19, may always be kept constant.

Depending on the method used, known heating and cooling systems, filters and dispensing nozzles for dispensing the treatment liquid, which have not been illustrated herein either, are provided in the tank.

The contacting electrodes 2, 8 are mounted vertically in the tank and are retained at the top and at the bottom by means of suited bearings (only partially shown). When viewed in the direction of transport, a first contacting electrode 2 with one cathodically polarized first segment 10 shown by way of example lies behind a second contacting electrode 8 with one anodically polarized second segment 9 shown by way of example. The second contacting electrode 8 disposed on the left-hand side is spaced from the work piece shown on the right-hand side in the tank and contacts the work piece shown on the left-hand side in the tank via first segment 10. By contrast, the contacting electrode 2 shown on the right-hand side, which is partially concealed by the contacting electrode 8 shown on the left-hand side, is spaced from the left work piece and contacts the right work piece through the first segment 10 thereof. Insulating pieces 3 are located between the segments.

For exerting pressure against the contacting electrodes 2, 8, the conveying and back-up rollers 11 may be carried in oval bearings or long holes (not shown) and be pressed by means of pinch springs 20 At the upper end of the contacting electrodes 2, 8 there are located collectors 22 with shoes 4. The respective ones of the shoes 4 are disposed at the side. Electric current is transmitted from the two poles of the current source 5 onto the respective one of the corresponding segments 9 and 10 of the contacting electrodes (the electric current transmission from the collectors to the segments 9, 10 is not shown herein), The negative pole of the current source 5 is connected to the outer shoes 4 that supply the first segments 10 of the contacting electrodes 2, 8 contacting the work piece 1 with current. The positive pole of the current source is connected to the inner shoes 4, which supply the second segments 9 of the contacting electrodes 2, 8 that are turned towards the work pieces on the respective other conveying path with current and spaced therefrom. The collectors 22 are disposed above the liquid level 19. They are connected to the individual segments of the contacting electrodes via lines that are not illustrated herein.

The offset (spacing) of the contacting electrodes 2 and 8 to each other and, as a result thereof also the diameter of the turn rollers not shown are to be chosen to be small enough to prevent a short from being produced between the work pieces 1 and the anodically polarized segments of the contacting electrodes 2, 8.

FIG. 8 shows a side view of a device according to the invention for electrolytically treating board-shaped work pieces 1 on either side thereof. The work pieces 1 are oriented horizontally and conveyed in a horizontal direction of transport 18. The boards are conducted in the upper position through a chamber 21, between the sealing rollers 16 on a forward route on conveying path T' prior to entering the processing tank. The tank is shown half cut-away for increased clarity. The electrolysis areas E, E' are again formed on the forward route between the cathodically polarized work pieces 1 and the anodically connected second contacting electrodes 8 and the additional anodes 14, respectively. At the end of the forward route, there is provided a transferring device 17 suited for transferring the board-shaped work pieces 1. The transferring device 17 is movably carried and is adapted to be moved up and down and back and forth in the direction as shown by the arrows through a dive that is not illustrated herein. The work pieces 1, which are moved uniformly in the direction of arrow 18, enter the transferring device 17 between the upper and lower conveying reels 11. As soon as the work piece 1 is only retained by the conveying reels 11 of the transferring device, said transferring device moves into the lower return position i.e., to the other conveying path T" of the assembly of the device, Once it has reached the lower position, the conveying reels 11 are driven in the opposite direction of rotation and convey the work piece on the lower returning conveying path T". There, the work piece 1 is seized by the contacting electrodes 8 together with the conveying reels 11, is contacted and conveyed through the device towards the exit 18 thereof and processed further. At the end of the row of assemblies, the work pieces 1 exit the tank through the slot sealed by the sealing rollers 16 and can be processed further according to the method sequence.

The forward and backward movement of the transferring device provided serves to keep the same spacing between adjacent boards during the transfer thereof, Sensors that are not illustrated herein may be provided for this purpose, said sensors registering the position of the leading board-shaped work pieces and accordingly controlling forward or backward movement of the transferring device in order to keep constant the spacing between successive boards 1. If the work pieces are only to be processed on one side, the transferring device may execute, instead of the up and down movement, a movement of rotation having the same radius as that of the turn rollers used for strip-form work pieces, in order to conduct the work pieces 1 to the returning conveying path T" of the device. It is then possible to keep the same spacing between adjacent boards by causing the transferring device to perform either a faster or a slower movement of rotation.

With this preferred embodiment it is thus possible to electrolytically process, at a low cost and with little maintenance expense, structures that are insulated against each other on a non-conductive carrier substrate.

In principle, FIG. 9 corresponds to FIG. 8, with no transferring device 17 being provided at the end of the row of assemblies. The work pieces 1 are instead caused to exit the tank through an exit region that is comparable to the entrance region (slots, sealing rollers, chamber). Accordingly, two parallel flows of boards are conducted through the device, The line is suited for processing both boards and strip-form work pieces. For treating the work pieces 1 on either side, these work pieces must in this case be plated through since separate electrical contact making on the side turned away from the assembly is not provided for.

FIG. 10 illustrates a contacting electrode 8 of the device that is shown interrupted at its center and has segments 9, 10 implemented in a particular way. The segments, which are seated on a corpus of the electrode 8 and are electrically insulated against each other by the insulating pieces 3, have boundaries that are inclined at an angle $\alpha>0$ to the direction of the axis 7 of the electrode 8 and are, as a result thereof, oriented at an incline with respect to the direction of transport of the work pieces. With this provision, a shielding effect produced by the insulating pieces 3 between the segments 9, 10 will not be transferred to certain regions on the work pieces but instead will be evened out.

FIG. 11 illustrates another embodiment of the segments 9, 10 according to FIG. 10, with the angle $\alpha$ of the boundary lines of the segments with respect to the axis 7 of the electrode 2, 8 having different values within one segment.

It is understood that the examples and embodiments described herein are for illustrative purpose only and that various modifications and changes in light thereof as well as combinations of features described in this application will be suggested to persons skilled in the art and are to be included within the spirit and purview of the described invention and within the scope of the appended claims. All publications, patents and patent applications cited herein are hereby incorporated by reference.

LISTING OF NUMERALS

1 work pieces
2 first segmented contacting electrode
3 insulating piece
4 shoe
5 current source
6 insulating ring
7 axis
8 second segmented contacting electrode
9 segment
10 segment
11 conveying reels/back-up rollers
12 insulating wall
13 re-directing/transferring means
14 additional electrode/anode
15 tank wall
16 sealing roller
17 transferring device
18 direction of transport of the work pieces 1
19 liquid level
20 pinch spring
21 splash guard chamber with collecting sump for the treatment liquid
22 collector
A assembly
S structure
T, T', T" conveying path
E, E' electrolysis area

The invention claimed is:

1. A device for electrolytically treating flat work pieces (1), said device comprising:

a) at least two conveying paths (T', T") that run substantially parallel to each other for conveying the work pieces thereon, b) at least one assembly (A) that is disposed between the conveying paths and that comprises a first rotatable contacting electrode (2) and a second rotatable contacting electrode (8), with the first and second contacting electrodes (2, 8) being associated with a respective one of the conveying paths where said electrodes (2, 8) abut against the work pieces (1) while being spaced from the respective other conveying path, with c) the first and second contacting electrodes (2, 8) comprising on the periphery thereof at least two segments (9, 10) each, that are insulated against each other and are connected to a current source (5), with d) a first segment (10) of the first contacting electrode (2), which abuts against the work pieces (1) being conveyed on a first conveying path (T'), and a first segment (10) of the second contacting electrode (8), which abuts against the work pieces (1) being conveyed on a second conveying path (T"), said first segments (10) being connected to a first pole of the current source (5) and with e) a second segment (9) of the first contacting electrode (2), which is turned towards the work pieces (1) being conveyed on the second conveying path (T") and is spaced from said second conveying path, and a second segment (9) of the second contacting electrode (8), which is turned towards the work pieces (1) being conveyed on the first conveying path (T') and is spaced from said first conveying path (T'), said second segments (9) being connected to a second pole of the current source (5), so that electrolysis areas (E) for processing the work pieces (1) are formed between the second segments (9) of the first and second contacting electrodes (2, 8) and the work pieces (1), a current flowing through said electrolysis areas (E), and f) the assembly (A) and the work pieces (1) being in contact with a treatment liquid.

2. The device according to claim 1, characterized in that the work pieces (1) comprise electrically conductive structures (S) that are electrically insulated against each other on the surfaces thereof and that the electrically conductive structures (S) have a length of 2-5 cm.

3. The device according to any one of the preceding claims 1-2, characterized in that the flat work pieces (1) are in the form of a strip or a board.

4. The device according to any one of the preceding claims 1-2 characterized in that the work pieces (1) are conveyed by means of the contacting electrodes (2, 8).

5. The device according to any one of the preceding claims 1-2, characterized in that at least one working electrode (14) is additionally provided, said working electrode being disposed on the side of the work pieces (1) that is turned away from the assembly (A) and that extends substantially transverse to the direction of transport (18).

6. The device according to any one of the preceding claims 1-2, characterized in that there is provided an insulating wall (12) between the rotatable contacting electrodes (2, 8) of an assembly (A).

7. The device according to any one of the preceding claims 1-2, characterized in that there are provided re-directing or transferring means (13, 17) for re-directing or transferring the work pieces (1) from a first conveying path (T') to a second conveying path (T").

8. The device according to claim 7, characterized in that the first conveying path (T') and the second conveying path (T") are associated with the same of the at least one assembly (A).

9. The device according to claim 7 characterized in that the work pieces (1) are routed forward and back several times on the conveying paths (T', T") in the device by means of the re-directing or transferring means (13).

10. The device according to anyone of the preceding claims 1-2, characterized in that there are provided at least two assemblies (A) that are arranged in a row one after another.

11. The device as according to claim 10, characterized in that an insulating wall (12) is disposed between two adjacent assemblies (A).

12. The device according to any one of claims, characterized in that the spacing between two first contacting electrodes (2) or two second contacting electrodes (8) of adjacent arrays (A) arranged in one row, said first and second contacting electrodes (2, 8) abutting against the work pieces (1) on one conveying path (T) is so small that the structures (S) are permanently contacted by at least one of the first and second contacting electrodes (2, 8), respectively.

13. The device according to any one of the preceding claims 1-2, characterized in that at least two assemblies (A) are disposed so as to be adjacent side by side in such a manner that they comprise a common conveying path (T) between them.

14. The device according to any one of claims 1-2, characterized in that at least two rows of adjacent assemblies (A) are provided.

15. The device according to claim 14, characterized in that the respective ones of the conveying paths (T', T") of the rows of assemblies (A) are connected to each other by the re-directing or transferring means (13).

16. The device according to any one of the preceding claims 1-2, characterized in that the work pieces (1) are oriented substantially horizontally and are conveyed on a substantially horizontally extending conveying path (T).

17. The device according to any one of the preceding claims 1-2, characterized in that the first and second segments (9, 10) extend axially on the first and second contacting electrodes (2, 8).

18. The device according to claim 17, characterized in that boundary lines between the first or second segments (9, 10), respectively, are inclined at an angle $\alpha>0$ to an axis (7) of the contacting electrodes.

19. The device according to claim 18, characterized in that the angle a of the at least one of the boundary lines between the first or second segments (9, 10), respectively, has different values in different regions of the contacting electrodes (2,8).

20. A method of electrolytically treating flat work pieces (1), comprising a) Conveying the work pieces on at least two conveying paths (T', T") that run substantially parallel to each other;

b) Contacting the work pieces with a treatment liquid;

c) Bringing the work pieces (1) into contact with at least one assembly (A) that is disposed between the conveying paths and that comprises a first rotatable contacting electrode (2) and a second rotatable contacting electrode (8), d) Electrically connecting the work pieces to a first pole of a current source (5) through a first segment (10) of the first contacting electrode (2), which abuts against the work pieces (1) being conveyed on a first conveying path (T'), and through a first segment (10) of the second contacting electrode (8), which abuts against the work pieces (1) being conveyed on a second conveying path (T") and e) Electrically connecting to a second pole of the current source (5) a second segment (9) of the first contacting electrode (2), which segment is turned towards the work pieces (1) being conveyed on the second conveying path (T") and is spaced from said second conveying path, and a second segment (9) of the second contacting electrode (8), which segment is turned towards the work pieces (1) being conveyed on the first conveying path (T') and is spaced from said first conveying path, so that electrolysis areas (E) for processing the work pieces (1) are formed between the second segments (9) of the first and second contacting electrodes (2, 8) and the work pieces (1) such that a current flows through said electrolysis areas (E).

21. The method according to claim 20, characterized in that the work pieces (1) comprise electrically conductive structures (S) that are electrically insulated against each other on the surfaces thereof and that the electrically conductive structures (S) have a size of 2-5 cm.

22. The method according to any one of claims 20 and 21, characterized in that the work pieces are treated by means of a row of adjacent assemblies (A).

23. The method according to claim 22, characterized in that the spacing between two first contacting electrodes (2) or two second contacting electrodes (8), abutting against the work pieces (1) and pertaining to adjacent assemblies (A) which are disposed in a row, is adjusted to be so small that the electrically conductive structures (S) are permanently contacted by at least one of the first or second contacting electrodes (2, 8), respectively.

24. The method according to any one of claims 20-21, characterized in that the work pieces (1) are conveyed several times back and forth through a processing tank filled with the treatment liquid by means of re-directing or transferring means (13).

25. The method according to any one of claims 20-21, characterized in that an insulating wall (12) mounted between the first and second contacting electrodes (2, 8) prevents a short from being produced between first and second segments (9, 10) being disposed on adjacent contacting electrodes (2, 8).

26. The method according to any one of claims 20-21, characterized in that the first segments (10) abutting against the work pieces (1) are cathodically polarized and that the second segments (9) that are spaced from the work pieces are anodically polarized so that metal be deposited onto the work pieces.

* * * * *

UNITED STATES PATENT AND TRADEMARK OFFICE

CERTIFICATE OF CORRECTION

PATENT NO. : 7,955,487 B2
APPLICATION NO. : 11/569825
DATED : June 7, 2011
INVENTOR(S) : Kohnle et al.

It is certified that error appears in the above-identified patent and that said Letters Patent is hereby corrected as shown below:

Column 11, line 24, reads "as dimethyl amino borane or a hyppphosphite in the reducer,"
should read -- as dimethyl amino borane or a hypophosphite in the reducer, --

Column 14, line 50, reads "rotate further, the potential of these first segments i0 changes"
should read -- rotate further, the potential of these first segments 10 changes --

Column 17, line 9, reads "shown by the arrows through a dive that is not illustrated"
should read -- shown by the arrows through a drive that is not illustrated --

Signed and Sealed this
Sixteenth Day of August, 2011

David J. Kappos

David J. Kappos
*Director of the United States Patent and Trademark Office*